US005214848A

United States Patent [19]

Lelievre

[11] Patent Number: 5,214,848

[45] Date of Patent: Jun. 1, 1993

[54] METHOD FOR MAKING A TUBE FOR A HEAT EXCHANGER

[75] Inventor: Gilbert Lelievre, Change, France

[73] Assignee: Valeo Thermique Moteur, Le Mesnil-Saint Denis, France

[21] Appl. No.: 882,587

[22] Filed: May 13, 1992

[30] Foreign Application Priority Data

May 14, 1991 [FR] France ..... 91 05826

[51] Int. Cl.[5] ..... B21D 41/00

[52] U.S. Cl. ..... 29/890.053; 72/367; 165/173; 29/890.043

[58] Field of Search ..... 165/153, 173; 29/890.053, 890.043; 72/367, 370

[56] References Cited

U.S. PATENT DOCUMENTS

| | | | |
|---|---|---|---|
| 3,922,768 | 12/1975 | Takayasu . | |
| 3,977,227 | 8/1976 | Noble | 72/367 |
| 4,028,037 | 6/1977 | Dawson | 425/392 |
| 4,456,059 | 6/1984 | Cadars . | |
| 4,476,704 | 10/1984 | Hage et al. | 72/276 |
| 4,546,824 | 10/1985 | Melnyk . | |
| 4,580,324 | 4/1986 | Laska | 29/890.053 |
| 5,046,348 | 9/1991 | Pratt | 72/356 |

FOREIGN PATENT DOCUMENTS

| | | | |
|---|---|---|---|
| 0108958 | 5/1984 | European Pat. Off. . | |
| 0387678 | 9/1990 | European Pat. Off. . | |
| 2235345 | 12/1976 | France . | |
| 2512941 | 3/1983 | France . | |
| 251602 | 11/1947 | Switzerland | 165/153 |

*Primary Examiner*—Allen J. Flanigan
*Attorney, Agent, or Firm*—Morgan & Finnegan

[57] ABSTRACT

A heat exchanger such as an engine cooling radiator for a motor vehicle has a tube bundle comprising a multiplicity of parallel heat exchange tubes arranged in at least one range, with each tube having a body terminating in an end portion which is received in a through hole formed in a header plate of the heat exchanger. The transverse cross section of the end portion of each tube has a perimeter which is smaller than that of the transverse cross section of the body of the tube. The value of the pitch between adjacent tubes may thus be optimized, while at the same time the size of the heat exchanger is reduced.

3 Claims, 1 Drawing Sheet

METHOD FOR MAKING A TUBE FOR A HEAT EXCHANGER

FIELD OF THE INVENTION

This invention relates to a heat exchanger of the kind having a tube bundle comprising a multiplicity of heat exchange tubes arranged in at least one range, with each said tube having a body which terminates in an end portion which is received in a hole formed in a header plate of the head exchanger. The invention also relates to a method for making such a heat exchanger.

The header plate is part of a manifold of the heat exchanger which is mounted at one end of the tube bundle, the other end of the latter being commonly, but not necessarily, provided with a similar manifold.

BACKGROUND OF THE INVENTION

Heat exchangers of the above kind are used in particular in motor vehicles having an internal combustion engine, so as to act either as a cooling radiator for the engine, or as a radiator or heat exchanger for heating the cabin of the vehicle. A cooling fluid, typically a mixture of water and glycol, flows through the tubes of the tube bundle in a closed circuit, being cooled by heat exchange with the air passing through the tube bundle outside the tubes.

It is conventional to provide the heat exchange tubes with a circular transverse cross section, both in their body and in their end portions. However, in order to optimise the performance of the exchangers of this type, it is also known to use heat exchange tubes in which the transverse cross section of the body is non-circular: this may simply be referred to as an oval cross section. This cross section is usually elliptical or similar, that is to say a planar cross section which is defined by two rectilinear parallel edges which are joined together through two semicircular edges.

In that case, the end portion of the tube usually has a transverse cross section which is of a different shape from that of the body of the tube. The end portion is generally less oblong than the body, and may typically be circular, so as to reduce the possibility of any deformation of the end portion. Since sealing between the end portion of the tube and the header plate is generally provided by means of a sealing gasket which is compressed between the end portion and a collar which surrounds the corresponding hole through the header plate, the pressure exerted by the gasket tends to cause flattening of the end portion, and thus deformation of the latter, if the end portion has a shape which is too markedly oblong.

Whatever the shape of the heat exchange tubes, and whatever type of header plate is used, it is necessary that the latter is as economical in material as possible, such that the pitch between any two adjacent holes for accommodating the heat exchange tubes is minimised, within either the same range of tubes or as between one range and the other. The material of the header plate lying between its holes must give sufficient mechanical strength to the header plate, and must be sufficient to enable a collar to be provided around each hole. Under these circumstances, it is difficult to optimise the tube pitches having regard to the dimensional constraints appropriate to the design of the heat exchanger, and in particular to that of its header plate.

DISCUSSION OF THE INVENTION

A major object of the invention is to overcome the drawbacks mentioned above. In particular, an object of the invention is to provide a heat exchanger between the tubes can be optimised within a given range of tubes, or if necessary as between one range and another, while still preserving a sufficiently large bridge of the material of the header plate between any one of its holes and another.

According to the invention in a first aspect, a heat exchanger that includes a bundle comprising a multiplicity of parallel tubes arranged in at least one range, in which each tube has a body terminating in an end portion which is received in a hole formed in a header plate, is characterised in that the transverse cross section of the end portion of the tube has a perimeter which is smaller than the perimeter of the transverse cross section of the body of the tube.

The header plate can then have a plurality of holes, in which the perimeter—and thus the transverse cross section —of each hole is then smaller than in the prior art. This enables the pitches to be reduced between the holes and thus between the tubes, either within any given range of tubes or as between one range and another if the heat exchanger is of the multi-range type. It is thus possible to provide heat exchangers which are more compact than in the prior art, without detriment to their performance.

The invention is thus applicable to heat exchangers of the single range type, comprising only one range of tubes connected in series, and also to heat exchangers of the multi-range type in which a plurality of ranges of tubes are arranged in parallel with each other with the tubes of each range being connected in series with each other.

According to a preferred feature of the invention, the body of each heat exchange tube has a circular transverse cross section, while its said end portion also has a transverse cross section which is circular, but which has a smaller diameter.

Preferably, the transverse cross section of the tube body is oval (as defined above), while the shape of the transverse cross section of its end portion is either oval or circular.

Preferably, the end portion of the tube is joined to its body through a deformed transition portion which at lest partly includes a bulge or bead extending radially outwardly, for retaining the header plate in position.

The end portion of the tube preferably has a radially expanded terminal portion lying on the opposite side of the header plate from the body of the tube, for retaining the header plate in position. In the case where both the bulge or bead, and the expanded terminal portion mentioned above, are provided, the header plate is held firmly in position on each tube of the bundle, by the bulge on one side of the plate and by the terminal portion on the other.

According to the invention of a second aspect, there is provided a method of making a heat exchanger according to the said aspect of the invention, in which the end portion of each tube is deformed in such a way as to cause the perimeter of its transverse cross section to be smaller than the perimeter of the transverse cross section of the body of the tube.

Preferably, the end portion of each tube is deformed by imposing a force on the said end portion in the longitudinal direction of the tube, by means of a reforming tool having a bore with a predetermined transverse cross section and having a widened mouth at its leading end, the said mouth having a conical edge.

In some cases, the end portion of the tube is deformed by successive introduction into a plurality of reforming tools which are such that the bore of a first said tool has a transverse cross section having a perimeter which is greater than the perimeter of the transverse cross section of the corresponding bore of the next said reforming tool.

A heat exchanger in a preferred embodiment of the invention, including a method of making it, are described below, by way of example only and with reference to the accompanying drawings.

DESCRIPTION OF A PREFERRED EMBODIMENT OF THE INVENTION

Figure 1:
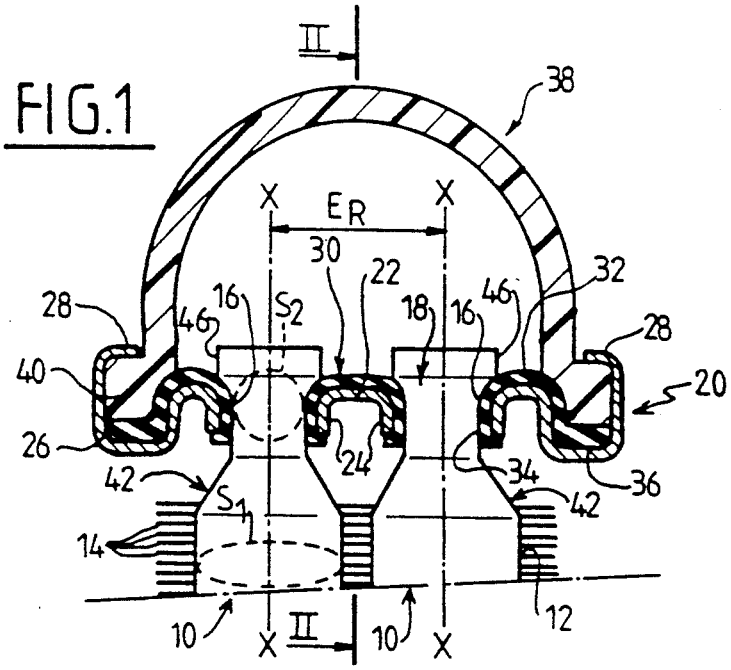
FIG. 1 is a view in transverse cross section of part of the preferred heat exchanger in accordance with the invention.
Figure 2:
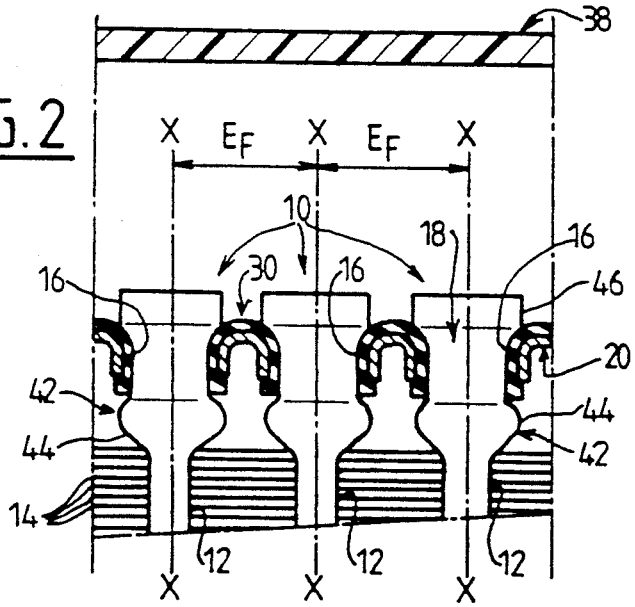
FIG. 2 is a partial view in cross section taken on the line II—II in FIG. 1.

The heat exchangers shown in FIGS. 1 and 2 comprise a bundle formed from a multiplicity of heat exchange tubes 10, with respective parallel axes XX which, in the example shown, are arranged in two sets or ranges connected in parallel with each other. Two adjacent tubes of the same range define a frontal or longitudinal pitch $E_F$ (FIG. 2) and a transverse or inter-range pitch $E_R$ (FIG. 1). Each heat exchange tube 10 in the bundle has a body 12 extending through a multiplicity of parallel cooling fins 14, and an end portion 16 which is received in a corresponding one of a set of holes 18 formed in a header plate 20.

The perforated header plate 20 is in the form of a generally rectangular metallic plate which is made by press forming. It has a generally rectangular spine portion 22, through which two rows of holes 18 are formed. In this example the holes 18 are circular. In each row the holes 18 define a pitch $E_F$, with a pitch $E_R$ between one row and the other. Each of the holes 18 in the header plate 20 is surrounded by a collar portion 24 which extends towards the fins 14. The spine portion 22 is surrounded by a flange portion 26 defining a peripheral groove which has a generally rectangular profile, the flange portion 26 being crenellated so as to define tabs 28 which are capable of being bent over.

The heat exchanger also includes a sealing gasket 30 of compressible material, having a generally rectangular spine portion 32 arranged to lie against the spine portion 22 of the header plate 20. The spine portion 32 of the gasket is formed with two sets of holes, each of which is edged with a collar portion 34 which is compressed between the end portion 16 of the corresponding heat exchange tube 10 and the corresponding collar portion 24 of the header plate 20. The spine portion 32 of the gasket 30 is itself edged with a peripheral bead 36, which is generally rectangular in plan and which fits in the peripheral groove defined within the flange portion 26 of the header plate.

The heat exchanger further includes a manifold wall 38 having an open face which is delimited by a generally rectangular peripheral flange 40. The latter causes the bed 36 of the sealing gasket 30 to be compressed when the tabs 28 of the header plate are bent over, so as to overlie the flange 40 as shown in FIG. 1.

In this embodiment, the body 12 of each heat exchange tube 10 has an elliptical transverse cross section S1 (see FIG. 1) for a given perimeter P1. The end portion 16 of each tube has a circular transverse cross section S2, having a perimeter P2 which is smaller than the perimeter P1 of the transverse cross section S1 of the body of the tube. This may be compared with the prior art arrangement in which the perimeter P2 of the transverse cross section S2 of the end portion of the tube was equal to, or greater than, the perimeter P1 of the transverse cross section S1 of the tube body. Consequently, by using heat exchange tubes each having a body the cross section of which is of predetermined shape, the arrangement shown in the drawings enables the value of the pitches $E_F$ and $E_R$ to be reduced, while still retaining a substantial enough bridge between two adjacent holes in the header plate. In this way, the heat exchanger is able to be made more compact than before, while the header plate still has adequate mechanical strength.

The end portion 16 of each heat exchange tube is joined to the body 12 of the tube through a deformed portion 42 representing a transition zone. In transverse cross section as shown in FIG. 1, the shape of this deformed portion is convergent from the tube body 12 towards the end portion 16. However, in its orthogonal cross section as shown in FIG. 2, the deformed portion 42 defines a radial bulge 44 which assists in supporting the header plate 20 on the tube end portions 16. It will be understood that the bulge 44 extends over part of the periphery of the transition zone 42.

As is clearly shown in FIGS. 1 and 2, the end portion 16 of each tube terminates in an expanded portion 46 lying beyond, i.e. above, the header plate 20. The expanded portion 46 is formed in any suitable known manner, e.g. by swaging, after the end portions 16 of the tubes have been inserted through the corresponding holes 18 in the header plate. The latter is thus located accurately on each heat exchange tube of the tube bundle, on one side of the latter by the bulge 44 and on the other side by the terminal expanded portion 46 of the tube.

At the other end of the tube bundle, the tubes may have their ends formed in a similar way, being then fixed to a header plate of a further manifold. In a modification, however, these other end portions may be joined together by means of U bends.

In the manufacture of the head exchanger shown in FIGS. 1 and 2, a tube bundle is first constructed from a number of heat exchange tubes with their respective tube bodies being fitted through a plurality of fins in any suitable known manner. In the example descried here, the respective end portions of the heat exchange tubes have the same initial, transverse cross section as their respective bodies, i.e. the end portions are oval in transverse cross section.

Figure 3:
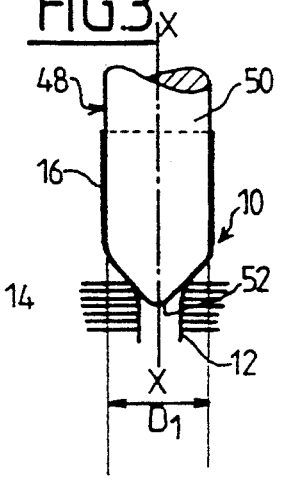
FIGS. 3, 4 and 5 show the end of one tube of the heat exchanger shown in FIGS. 1 and 2, during three successive phases in its manufacture.

In a first operation, illustrated in FIG. 3, a swaging tool 48, having a cylindrical body portion 50 with a transverse cross section that terminates in a generally frusto-conical nose portion 52, is introduced into each tube end portion in the axial direction XX of the tube 10. The tool 48 deforms the end portion 16 of the tube from its initial elliptical transverse cross section S1 (having a perimeter P1) into a circular cross section having an internal diameter D1, the perimeter of which is equal to, or greater than, the perimeter P1.

Figure 4:
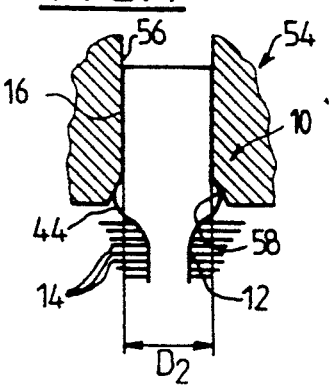

In a second operation shown in FIG. 4, the end portion 16 of the tube, deformed in the first operation, is worked by means of a first or only reforming tool in the form of a die 54 having a cylindrical bore 56. The circular internal cross section of the bore 56 has a diameter D2, such that D2 is smaller than D1. The bore 56 terminates in a widened mouth 58 having a conical edge. Thus, when the end portion 16 of the heat exchange tube 10 is introduced into the bore 56 of the reforming tool 54, the material of the end portion of the tube is upset so that its diameter is reduced, with the radial bulge or bead 44 described above being formed at the same time.

Figure 5:
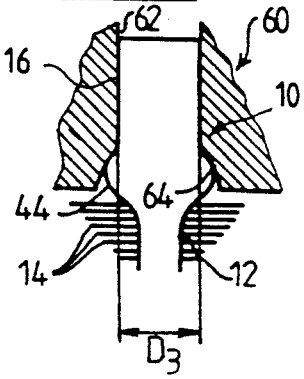

FIG. 5 shows a third operation which may then be carried out, and in which the end portion 16, reformed as described above the reference to FIG. 4, is introduced into a second reforming tool 60 which is similar to the reforming tool 54. The tool 60 has a cylindrical bore 62, the transverse cross section of which has a diameter D3, such that D3 is smaller than D2. The bore 62 terminates in a widened mouth 64 having a conical edge. Thus this third operation reduces the diameter of the tube end portion 16 further, and enlarges the radial bulge 44. It will be understood that one or more further reforming tools, similar to those described, may be used as required, for reducing the transverse cross section of the end portion of the tube even more.

Each of the operations described above with reference to FIGS. 3 to 5 is preferably carried out on all the tubes of the tube bundle at the same time. Thus for example, for the initial swaging operation shown in FIG. 3, the tool 48 preferably consists of a single tool having as many tool elements comprising body portion 50 and nose portions 52 as there are tubes to be operated on. In the same way, each reforming tool preferably has as many bores 56 or 62 as there are tubes to be operated on.

As already mentioned, the heat exchanger may have one or more parallel ranges of heat exchange tubes.

Although a particular embodiment of the invention is described above, in which each tube has a body with an oval transverse cross section and an end portion having a circular transverse cross section, it is to be understood that the invention is applicable to other types of tube, for example a tube having a body with an oval cross section and an end portion which also has an oval cross section. The invention is also applicable to tubes having a body with a circular cross section and an end portion which also has a circular cross section.

In addition, although the invention has been described above with particular reference to a heat exchanger in which the end portions of the tubes are fitted in a header plate formed with collar portions and with a sealing gasket interposed, it is applicable equally to other types of header plate. Thus for example, the end portions of the tubes may be fitted in holes in the header plate by an other known means, for example by pressing, adhesive bonding etc.

What is claimed is:

1. A method of making a tube for a heat exchanger said heat exchanger tube having a body and an end portion joined to the body, the transverse cross section of the end portion of each tube having a perimeter which is smaller than the perimeter of the transverse cross section of the body of the tube, wherein the method includes the step of deforming the end portion of each heat exchange tube by reforming it in such a way as to cause the perimeter of its transverse cross section to become smaller than that of the transverse cross section of the body of the tube and to form a radial bulge in each said tube member between its respective end portion and its respective body portion.

2. A method according to claim 7, wherein the method includes the step of providing a reforming die tool having a bore defining a transverse cross section of predetermined shape and a widened mouth terminating said bore, said mouth defining a conical edge, the step of deforming the end portion of the tube comprising introducing the end portion into said bore in the longitudinal direction of the tube.

3. A method according to claim 2, further including providing a plurality of said reforming die tools in which the transverse cross section of each tool has a perimeter different from that of the transverse cross section of the bore of the other tool or tools, the step of deforming the end portion of each tube comprising the successive operations of introducing the end portion into a first said tool, whereby to partly reform the end portion and form a radial bulge, and then introducing it into a further said tool in which the transverse cross section of the bore has a smaller perimeter than that of the first said tool.

* * * * *